US005324583A

United States Patent [19]

Ozaki

[11] Patent Number: 5,324,583

[45] Date of Patent: Jun. 28, 1994

[54] THERMAL TRANSFER SHEET

[75] Inventor: Yoshihide Ozaki, Machida, Japan

[73] Assignee: Diafoil Hoechst Company, Limited, Tokyo, Japan

[21] Appl. No.: 992,165

[22] Filed: Dec. 17, 1992

[30] Foreign Application Priority Data

Dec. 19, 1991 [JP] Japan ..... 3-337303

[51] Int. Cl.[5] ..... B41M 5/40

[52] U.S. Cl. ..... 428/336; 428/195; 428/412; 428/473.5; 428/476.3; 428/480; 428/500; 428/913; 428/914

[58] Field of Search ..... 428/195, 488.4, 913, 428/914, 500, 336, 412, 473.5, 476.3, 480

[56] References Cited

FOREIGN PATENT DOCUMENTS 314205 5/1989 European Pat. Off. ..... 428/488.4
314348 5/1989 European Pat. Off. ..... 428/488.4
458538 11/1991 European Pat. Off. ..... 428/488.4

OTHER PUBLICATIONS

Japanese Patent Kokai Publ. No. 7467/1980 (Abstract).
Japanese Patent Kokai Publ. No. 128789/1982 (Abstract).
Japanese Patent Kokai Publ. No. 27289/1986 (Abstract).
Japanese Patent Kokai Publ. No. 207679/1987 (Abstract).

*Primary Examiner*—Pamela R. Schwartz
*Attorney, Agent, or Firm*—Foley & Lardner

[57] ABSTRACT

A thermal transfer sheet having a base film, a heat resistant layer which is formed on one surface of the base film by coating a composition which contains (A) a compound having at least two (meth)acryloyl groups and (B) at least one polymer selected from the group consisting of a syrene-alkyl (meth)acrylate copolymer and an α-methylstyrene-alkyl (meth)acrylate copolymer and cured with an activation energy ray, and heat transfer coloring material layer on the other surface of the base film, which sheet has maintains good runnability and prevents deposition of a thermal head tailings.

20 Claims, No Drawings

THERMAL TRANSFER SHEET

BACKGROUND OF THE INVENTION

1. Field of the Invention

The present invention relates to a thermal transfer sheet which is used in a recording system for thermally transferring a coloring material with heat-application means such as a thermal head.

2. Description of the Related Art

With the development of office automation, a thermal transfer recording system is used in various terminal equipments such as a facsimile machine or a printing machine. This recording system is advantageous over other recording systems such as electrophotographic type or ink jet type ones because of easy maintenance of the machine, easy operability, low costs of the machine and consumables.

Since the thermal transfer sheet is heated with a thermal head at high temperature in the thermal transfer recording system, if a base film of the thermal transfer sheet has insufficient heat resistance, it is fusion-bonded to the thermal head, which results in generation of sticking noise or deposition of thermal head tailings. When the fusion bonding becomes severe, running of the thermal head is impossible so that no recording is possible.

To solve this problem, Japanese Patent Kokai Publication No. 7467/1980 proposes the supply of a heat resistant resin layer such as a silicone resin or an epoxy resin on the base film, and Japanese Patent Kokai Publication No. 129789/1982 proposes the supply of a resin layer containing a surfactant which is in a solid or semi-solid state at room temperature on the base film. However, these measures require a large amount of energy for heat-curing the resin. In addition, the base film suffers from deformation wrinkles caused by heat, so that the coloring material layer is irregularly coated on the base film and therefore printing quality is deteriorated. When the surfactant is added to the resin layer, it will adhere to the thermal head to cause printing slips.

With the increase of the energy applied to the thermal head due to recent high speed printing, the thermal transfer sheet receives large load. Then, it is difficult to improve the runnability of the thermal head by the methods disclosed in the above Japanese Patent Kokai Publications.

As further methods for solving the above problem, Japanese Patent Kokai Publication No. 27289/1986 proposes the supply of a heat resistant layer of a UV-curable resin such as polyester acrylate on the base film and Japanese Patent Kokai Publication No. 207679/1987 proposes the supply of a cured layer of a silicone having radically polymerizable double bonds.

While the base film having such layer is excellent in heat resistance, it has an insufficient slipping property, so that the runnability of the thermal head may not be improved, or the uncured silicone migrates on a surface of the base film on which the coloring material layer will be formed. Thereby, the coloring material layer is irregularly coated. In addition, the uncured silicone migrates in the coloring material layer so that the normal printing is interfered.

To reduce recording cost in the thermal transfer recording system, a repeated use type thermal transfer sheet is being developed. Therefore, a heat resistant layer is required, which does not deteriorate the runnability of the thermal head even when it is repeatedly heated by the thermal head and prevents deposition of the thermal head tailings.

SUMMARY OF THE INVENTION

An object of the present invention is to provide a thermal transfer sheet which maintains good runnability of the thermal head even at high energy recording and keeps the thermal head clean after the repeated printing.

According to the present invention, there is provided a thermal transfer sheet comprising a base film, a heat resistant layer which is formed on one surface of said base film by coating a composition which comprises (A) a compound having at least two (meth)acryloyl groups and (B) at least one polymer selected from the group consisting of a styrene-alkyl (meth)acrylate copolymer and an α-methylstyrene-alkyl (meth)acrylate copolymer and cured with an activation energy ray, and heat transfer coloring material layer on the other surface of said base film.

DETAILED DESCRIPTION OF THE INVENTION

An example of the compound having at least two (meth)acryloyl group is a reaction product of a di- or polyhydric alcohol or its derivative and a compound having an acryloyl or methacryloyl group. A specific example is a reaction product of a polyhydric alcohol and (meth)acrylic acid or its halide or lower alkyl ester. Examples of the polyhydric alcohol are ethylene glycol, propylene glycol, butylene glycol, diethylene glycol, tetraethylene glycol, trimethylolpropane, pentaglycerol, pentaerithritol, dipentaerithritol, glycerol, diglycerol, and the like. A preferred reaction product is a compound in which a group bridging the (meth)acryloyl groups is a hydrocarbon group having 20 or less carbon atoms, in particular 10 or less carbon atoms and no or one ether group, for example, trimethylolpropane tri(meth)acrylate, pentaglycerol tri(meth)acrylate, pentaerithritol tetra(meth)acrylate, dipentaerithritol hexa(meth)acrylate, ethyleneglycol (meth)acrylate, propyleneglycol di(meth)acrylate, butyleneglycol di(meth)acrylate, and the like.

Examples of the styrene-alkyl (meth)acrylate copolymer or α-methylstyrene-alkyl (meth)acrylate copolymer are copolymers of styrene or α-methylstyrene with methyl (meth)acrylate, ethyl (meth)acrylate, n-propyl (meth)acrylate, n-butyl (meth)acrylate, isobutyl (meth)acrylate, tert.-butyl (meth)acrylate, 2-hydroxyethyl (meth)acrylate, hexyl (meth)acrylate, octyl (meth)acrylate, dodecyl (meth)acrylate, stearyl (meth)acrylate and the like.

Preferably, the styrene-alkyl (meth)acrylate copolymer or α-methylstyrene-alkyl (meth)acrylate copolymer has a number average molecular weight of 1000 to 10,000.

A total amount of the polymer (B) is preferably from 0.1 to 30% by weight, more preferably from 0.5 to 20% by weight based on the whole weight of the heat resistant layer. When the total amount is less than 0.1% by weight, the slipping property against the thermal head is not sufficient during thermal transfer recording.

In the thermal transfer sheet of the present invention, the compound (A) and the polymer (B) are used in a weight (or molar) ratio of from 99.9:0.1 to 20:30, preferably from 99.5:0.5 to 30:20.

In addition to the above two essential compounds, the heat resistant layer of the present invention may contain a copolymerizable monomer to improve the coating property. Specific examples of the copolymerizable monomer are acrylic acid, methacrylic acid and crotonic acid or their esters with an alcohol (e.g. methanol, ethanol, propanol, butanol, isopropanol, hexanol, 2-ethylhexanol, cyclohexanol, benzylalcohol, stearylalcohol, ethylene glycol, propylene glycol, diethylene glycol, glycerol, etc.), glycidyl (meth)acrylate, allyl glycidyl ether, acrylonitrile, methacrylonitrile, vinyl acetate, styrene, α-methylstyrene, α-chlorostyrene, (meth)acrylamide, N-methylolacrylamide, N-butoxymethyl (meth)acrylamide, unsaturated polyester dimethacrylate, vinyltriethoxysilane, vinyltrimethoxysilane, acryloyloxypropyltriethoxysilane, methacryloyloxypropyltriethoxysilane, acryloyloxypropyltrimethoxysilane, methacryloyloxytrimethoxysilane, and the like. An amount of the copolymerizable monomer preferably does not exceed 50% by weight of the heat resistant layer.

In addition, a photopolymerizable oligomer may be used. Examples of the photopolymerizable oligomer are epoxy (meth)acrylate, epoxidized oil (meth)acrylate, urethane acrylate, polyester (meth)acrylate, polyether (meth)acrylate, silicone (meth)acrylate, polybutadiene (meth)acrylate, polystyryl (meth)acrylate, phosphazene base (meth)acrylate, and the like.

The heat resistant layer of the present invention may contain an initiator such as a polymerization initiator or a photosensitizer. Examples of the polymerization initiator are 2,2-ethoxyacetophenone, 1-hydroxycyclohexyl phenyl ketone, dibenzoyl, benzoin, benzoin methyl ether, benzoin ethyl ether, benzoin isopropyl ether, p-chlorobenzophenone, p-methoxybenzophenone, Michler's ketone, acetophenone, 2-chlorothioxanthone, anthraquinone, phenyldisulfide, 2-methyl-[4-(methylthio)phenyl]-2-morpholinopropanone-1, and the like. They may be used independently or as a mixture thereof.

An amount of the polymerization initiator is from 0.05 to 5 parts by weight per 100 parts of the total amount of the materials contained in the heat resistant layer.

Examples of the photosensitizer are tertiary amines (e.g. triethylamine, triethanolamine, 2-dimethylaminoethanol, etc.), arylphosphines (e.g. triphenylphosphine, etc.), thioethers (e.g. β-thioglycol, etc.), and the like. They may be used independently or as a mixture thereof.

An amount of the photosensitizer is from 0.05 to 5 parts by weight per 100 parts of the total amount of the materials contained in the heat resistant layer.

In order to further improve the slipping property of the thermal transfer sheet against the thermal head, the heat resistant layer may further contain an organic or inorganic particles.

To prevent electrification of the thermal transfer sheet, the heat resistant layer may contain an electrically conductive powder such as a metal, a metal oxide or conductive carbon black, or an antistatic agent.

In desired, the heat resistant layer may contain other additives such as a foam-inhibitor, a coating improver, a tackifier, and the like.

In the present invention, the heat resistant layer composition containing the above components is applied on one surface of the base film by a conventional method and then irradiated with the activation energy ray to form the heat resistant layer.

Examples of the activation energy ray are UV light, visible light, electron ray, X-ray, α-ray, β-ray, γ-ray and the like.

Usually, the activation energy ray is irradiated on the coated side, although it is possible to provide a reflection plate on the base film side to improve the adhesion of the heat resistant layer to the base film, or the activation energy ray is irradiated from the base film side.

A thickness of the heat resistant layer is usually from 0.05 to 5μm, preferably from 0.1 to 3μm.

As the base film, any of the conventionally used films may be used. Examples of the base film are polyester film (e.g. polyethylene terephthalate film, polyethylene naphthalate film, poly-1,4-cyclohexylenedimethylene terephthalate film, etc.), polyimide film, aromatic polyamide film, polycarbonate film, and the like. Among them, a biaxially oriented polyester film is preferred in view of mechanical strength, dimensional stability, heat resistance and a cost.

A thickness of the base film is usually from 2 to 15μm.

In the present invention, the coloring material layer may be formed by a conventional method. For example, in the case of a sublimation type thermal transfer sheet, a sublimable coloring material and a binder resin with good heat resistance are dissolved or dispersed in a suitable solvent to prepare a paint. Then, the paint is coated on the other surface of the base film and dried. In the case of a melting type thermal transfer sheet, a colorant such as a pigment or a dye is dissolved or dispersed in a heat-melting material, optionally using a solvent to prepare a paint, which is then coated on the other surface of the base film and dried.

Examples of the sublimatable coloring material are nonionic azo dyes, anthraquinone dyes, azomethine dyes, methine dyes, indoaniline dyes, naphthoquinone dyes, quinophthalone dyes, nitro dyes, and the like.

Examples of the binder resin are polycarbonate resins, polysulfone resins, polyvinylbutyral, resins, polyarylate resins, polyamide resins, polyaramide resins, polyimide resins, polyetherimide resins, polyester resins, acrylonitrile-styrene resins, cellulose resins (e.g. acetylcellulose, methylcellulose, ethylcellulose, etc.), and the like.

Examples of the solvent are aromatic solvents (e.g. toluene, xylene, etc.), ketone solvents (e.g. methyl ethyl ketone, methyl isobutyl ketone, cyclohexanone, etc.), ester solvents (e.g. ethyl acetate, butyl acetate, etc.), alcohol solvents (e.g. isopropanol, butanol, methylcellosolve, etc.), halohydrocarbon solvents, (e.g. methylene chloride, trichloroethylene, chlorobenzene, etc.), ether solvents (e.g. dioxane, tetrahydrofuran, etc.), amide solvents (e.g. dimethylformamide, N-methylpyrrolidone, etc.), and the like.

Example of the colorant used in the melting type thermal transfer sheet are inorganic pigments (e.g. carbon black) and organic pigments (e.g. azo pigments, fused polycyclic compounds, etc.). As the dye, acid dyes, base dyes, metal complex dyes, oil-soluble dyes, and the like are used. As the heating melting material, a solid or semisolid material having a melting point of 40° to 120° C. is preferred. Examples of such material are carnauba wax, montan wax, microcrystalline wax, Japan wax, fat-oil base synthetic wax, and the like.

The coloring material layer may optionally contain organic or inorganic particles, a dispersant, an antistatic agent, an anti-blocking agent, a foam-inhibitor, an antioxidant, a viscosity regulator, and the like. To achieve the plural printings, the coloring material layer may have a stone wall structure in which heat resistant fine particles are filled, or a porous structure of a heat resistant resin.

Between each of the layers and the base film, an intermediate layer such as an adhesion enhancing layer, an antistatic layer, a peeling layer, and the like may be provided.

If desired, the surface or surfaces of the base film may be treated by, for example, corona discharge to enhance the adhesion.

PREFERRED EMBODIMENTS OF THE INVENTION

The present invention will be illustrated by following Examples, in which "parts" are by weight.

EXAMPLE 1

On one surface of a biaxially oriented polyethylene terephthalate film having a thickness of 5.5 μm, a coating paint having the following composition was gravure coated, dried and cured by the irradiation with a high pressure mercury lamp having an energy of 120 W/cm from a distance of 150 mm for about 15 seconds to form a heat resistant layer having a thickness of 0.5 μm:

| Component | Parts |
|---|---|
| Pentaerithritol triacrylate | 30 |
| Bisphenol A type epoxy acrylate | 10 |
| Styrene-butyl acrylate copolymer (molecular weight of about 2700) | 1 |
| 2-Methyl-[4-(methylthio)phenyl]-2-morpholinopropanone-1 | 2 |
| Methyl ethyl ketone | 100 |
| Toluene | 100 |

On the other surface of the above coated base film, a coloring material layer having the following composition was hot melt coated at a thickness of 4 μm to obtain a thermal transfer sheet:

| Component | Parts |
|---|---|
| Carbon black | 20 |
| Paraffin wax | 40 |
| Carnauba wax | 30 |
| Ethylene-vinyl acetate copolymer | 10 |

EXAMPLE 2

In the same manner as in Example 1 except that a coating paint for the heat resistant layer having the following composition was used, a thermal transfer sheet was produced:

| Component | Parts |
|---|---|
| Pentaerithritol tetraacrylate | 30 |
| Bisphenol A type epoxy acrylate | 20 |
| Styrene-butyl acrylate-methyl methacrylate copolymer (molecular weight of about 2900) | 1 |
| 2-Methyl-[4-(methylthio)phenyl]-2-morpholinopropanone-1 | 2 |
| Methyl ethyl ketone | 100 |
| Toluene | 100 |

COMPARATIVE EXAMPLE 1

In the same manner as in Example 1 except that a coating paint for the heat resistant layer having the following composition was used, a thermal transfer sheet was produced:

| Component | Parts |
|---|---|
| Pentaerithritol triacrylate | 30 |
| Bisphenol A type epoxy acrylate | 10 |
| 2-Methyl-[4-(methylthio)phenyl]-2-morpholinopropanone-1 | 2 |
| Methyl ethyl ketone | 100 |
| Toluene | 100 |

COMPARATIVE EXAMPLE 2

In the same manner as in Example 1 except that a coating paint for the heat resistant layer having the following composition was used, a thermal transfer sheet was produced:

| Component | Parts |
|---|---|
| Single end methacryloxypropyl group-containing polydimethylsiloxane (molecular weight of about 5000) | 42 |
| 2-Methyl-[4-(methylthio)phenyl]-2-morpholinopropanone-1 | 2 |
| Methyl ethyl ketone | 100 |
| Toluene | 100 |

COMPARATIVE EXAMPLE 3

In the same manner as in Example 1 except that a coating paint for the heat resistant layer having the following composition was used, a thermal transfer sheet was produced:

| Component | Parts |
|---|---|
| Pentaerithritol triacrylate | 30 |
| Bisphenol A type epoxy acrylate | 10 |
| Single end methacryloxypropyl group-containing polydimethylsiloxane (molecular weight of about 5000) | 1 |
| 2-Methyl-[4-(methylthio)phenyl]-2-morpholinopropanone-1 | 2 |
| Methyl ethyl ketone | 100 |
| Toluene | 100 |

Each of the thermal transfer sheets prepared in examples and comparative examples was subjected to the following evaluation tests.

(1) Anti-Sticking Property and Printing Property

Using a line-type thermal head, the anti-sticking property and the printing property were evaluated under the following recording conditions:

Recording conditions
- Recording density: 4 dots/nun
- Recording power: 0.7 W/dot
- Head heating time: 4 msec.

Image receiving paper
- Fine quality paper

The evaluation criteria are as follows:

( i ) Anti-sticking property
- ○: No sticking
- Δ: Slight sticking
- ×: Heavy sticking to prevent running of the thermal head (ii) Printing property ○: No slip, blur or spreading (peripheral parts of the printed portion being transferred to cause fading of a printed image)
Δ: Slight slip, blur or spreading
×: Considerable slip, blur or spreading (2) Thermal Head Contamination After continuously (1 m long) printing under the same conditions as above, a surface of the thermal head was observed and evaluated according to the following criteria:
○: No head tailings
Δ: A few head tailings
×: Many head tailings The results are shown in the following Table.

TABLE

| Example No. | Anti-sticking property | Printing property | Thermal head contamination |
|---|---|---|---|
| 1 | ○ | ○ | ○ |
| 2 | ○ | ○ | ○ |
| Comp. 1 | X | — | — |
| Comp. 2 | ○ | X | X |
| Comp. 3 | Δ-X | Δ | Δ |

With the thermal transfer sheets produced in Examples 1 and 2, the thermal head and the thermal transfer sheet were not fused together, and the sheet smoothly run and good images were transferred.

In Comparative Example 1, the thermal transfer sheet sticked to the thermal head and did not run.

In Comparative Example 2, though the thermal transfer sheet run, the coloring material layer had coating irregularity due to the migration of the chemicals from the heat resistant layer, may slips were found in the coloring material layer after transfer, and an amount of the head tailings was large.

In Comparative Example 3, the thermal transfer sheet sticked to the thermal head so that it did not run smoothly.

EXAMPLE 3

In the same manner as in Example 1 except that a thickness of the heat resistant layer was increased to 1 μm and a coloring material paint having the following composition was used, a thermal transfer sheet was produced:

| Component | Parts |
|---|---|
| Sublimable dye (C.I. Solvent Blue 95) | 5 |
| Polysulfone resin | 10 |
| Chlorobenzene | 85 |

Separately, a coating liquid containing a polyester resin (trade name: Vylon 200 manufactured by Toyobo Co., Ltd.) (100 parts), an amino-modified silicone oil (trade name: AFL 40 manufactured by Nippon Unicar Co., Ltd.) (0.5 part), methyl ethyl ketone (15 parts) and toluene (15 parts) was coated on a polypropylene synthetic paper having a thickness of 100 μm and dried to form an image-receiving material having a dyeing layer of 5 μm in thickness.

The thermal transfer sheet and the image-receiving material were laminated with facing the coloring material layer and the dyeing layer each other, and on the laminated sheet, an image was printed at a recording density of 4 dots/mm, a recording power of 0.8 W/dot and a head heating time of 8 msec.

The laminated sheets smoothly run and good transferred image was formed.

After printing, the thermal head was observed but no head tailings was found.

EXAMPLE 4

In the same manner as in Example 1 except that the coloring material layer having the following composition was coated on the other surface of the base film through an adhesive layer containing a polyester resin, a thermal transfer sheet was produced:

| Component | Parts |
|---|---|
| Fatty acid amide | 38 |
| Paraffin wax | 18 |
| Black azo dye | 18 |
| Carbon black | 4 |
| Alumina | 4 |
| Acetone | 400 |

The thickness of the coloring material layer was about 10 μm.

Using the produced thermal transfer sheet, an image was printed at a recording density of 4 dots/mm, a recording power of 0.4 W/dot and a head heating time of 4 msec.

As a recording paper, a Zerox paper (Type PA4 manufactured by Kishu Paper Making Co., Ltd. having a Beck smoothness of 50 to 70 seconds) was used.

After ten times repeated printings, the thermal transfer sheet run smoothly and a good image was printed. No head tailings was found.

What is claimed is:

1. A thermal transfer sheet comprising:
(i) a base film,
(ii) a cured heat resistant layer which is formed on one side of said base film from
(A) at least one compound having at least two (meth)acryloyl groups, and
(B) at least one polymer selected from the group consisting of a styrene-alkyl (meth)acrylate copolymer and an α-methyl-styrene-alkyl (meth)acrylate copolymer, and
(iii) a heat transfer coloring material layer on the other side of said base film.

2. The thermal transfer sheet according to claim 1, wherein (a) comprises at least one compound selected from the group consisting of trimethylolpropane tri(meth)acrylate, pentaglycerol tri(meth)acrylate, pentaerythritol tetra(meth)acrylate, dipentaerithritol hexa(meth)acrylate, ethyleneglycol (meth)acrylate, propyleneglycol di(meth)acrylate, pentaerythritol tri(meth)acrylate and butyleneglycol di(meth)acrylate.

3. The thermal transfer sheet according to claim 1, wherein (B) comprises a copolymer comprising styrene or α-methylstyrene and at least one (meth)acrylate selected from the group consisting of methyl (meth)acrylate, ethyl (meth)acrylate, n-propyl (meth)acrylate, n-butyl (meth)acrylate, isobutyl (meth)acrylate, ter.-butyl (meth)acrylate, 2-hydroxyethyl (meth)acrylate, hexyl (meth)acrylate, octyl (meth) acrylate, dodecyl (meth) acrylate and stearyl (meth) acrylate.

4. The thermal transfer sheet according to claim 1, wherein (B) comprises a polymer having a number average molecular weight of 1000 to 10,000.

5. The thermal transfer sheet according to claim 1, wherein said heat resistant layer is further formed from a copolymerizable monomer.

6. The thermal transfer sheet according to claim 1, wherein said heat resistant layer is formed using an initiator.

7. The thermal transfer sheet according to claim 1, wherein said heat resistant layer further contains an electrically conductive powder or an antistatic agent.

8. The thermal transfer sheet according to claim 1, wherein the heat resistant layer is coated onto the base film.

9. The thermal transfer sheet according to claim 1, wherein the heat resistant layer was cured by an activation energy ray.

10. The thermal transfer sheet according to claim 1, wherein (A) comprises a reaction product of a di- or polyhydric alcohol and a compound having an acryloyl or methacryloyl group.

11. The thermal transfer sheet according to claim 1, wherein (B) comprises a polymer consisting essentially of one or more of styrene or α-methylstyrene and one or more alkyl (meth)acrylates.

12. The thermal transfer sheet according to claim 1, wherein the total amount of (B) is from 0.1 to 30% by weight based on the weight of the heat resistant layer.

13. The thermal transfer sheet according to claim 1, wherein (A) and (B) are present in the heat resistant layer in a weight ratio of 99.9:0.1 to 20:30.

14. The thermal transfer sheet according to claim 1, wherein the heat resistant layer is further formed from one or more of a photopolymerizable oligomer or a photosensitizer.

15. The thermal transfer sheet according to claim 1, wherein the heat resistant layer further contains one or more of organic or inorganic particles in an amount sufficient to improve the slipping properties of the thermal transfer sheet.

16. The thermal transfer sheet according to claim 1, wherein the heat resistant layer has a thickness from 0.05 to 5 micrometers.

17. The thermal transfer sheet according to claim 1, wherein the base film comprises a film selected from the group consisting of a polyester film, a polyimide film, an aromatic polyamide film, and a polycarbonate film.

18. The thermal transfer sheet according to claim 1, wherein the base film comprises a biaxially oriented polyester film having a thickness of from 2 to 15 micrometers.

19. The thermal transfer sheet according to claim 1, wherein the heat transfer coloring material comprises a binder resin and a colorant.

20. The thermal transfer sheet according to claim 1, which contains an intermediate layer between the base film and the heat resistant layer or between the base film and the heat transfer coloring material layer.

* * * * *